US005199636A

United States Patent [19]

Young

[11] Patent Number: 5,199,636

[45] Date of Patent: Apr. 6, 1993

[54] GIFT MAILING BOX

[76] Inventor: Lincoln L. C. Young, 4449 Candleberry Ave., Seal Beach, Calif. 90740

[21] Appl. No.: 831,798

[22] Filed: Feb. 5, 1992

[51] Int. Cl.[5] ..... B65D 5/22

[52] U.S. Cl. ..... 229/151; 229/165; 229/177

[58] Field of Search ..... 229/147, 151, 165, 178, 229/177

[56] References Cited

U.S. PATENT DOCUMENTS

| | | | |
|---|---|---|---|
| 2,169,065 | 8/1939 | Cole | 229/147 |
| 2,548,001 | 4/1951 | Butterfill | 229/147 |
| 3,100,642 | 8/1963 | Goldstein | 229/8 |
| 3,291,367 | 12/1966 | Carter | 229/147 |
| 3,394,867 | 7/1968 | Gregg | 229/147 |
| 3,543,995 | 12/1970 | Wilson | 229/178 |
| 3,826,420 | 7/1974 | Bamburg et al. | 229/178 |
| 4,168,028 | 9/1979 | McCall | 229/178 |
| 4,265,393 | 5/1981 | Orchard | 229/147 |
| 4,441,626 | 4/1984 | Hall | 229/178 |

FOREIGN PATENT DOCUMENTS

| | | | |
|---|---|---|---|
| 263292 | 9/1964 | Australia | 229/147 |

*Primary Examiner*—Allan N. Shoap
*Assistant Examiner*—Christopher McDonald
*Attorney, Agent, or Firm*—Lewis Anten

[57] ABSTRACT

A mailing box made of corrugated cardboard is formed from a single scored piece of corrugated cardboard that when folded provides multiple layers of support at the corners of the box providing extra strength for protection against crushing. The box is constructed so as to permit folding in such a way as to be self locking and has pressure sensitive adhesive means applied to interior surfaces for sealing the box when folded. The gift box has two layers of cardboard at the rear corners and four layers of cardboard at the front corners to provided increased protection from crushing.

9 Claims, 4 Drawing Sheets

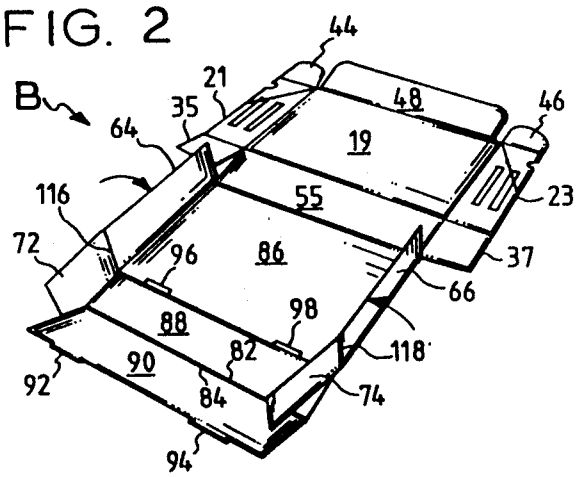
FIG. 2
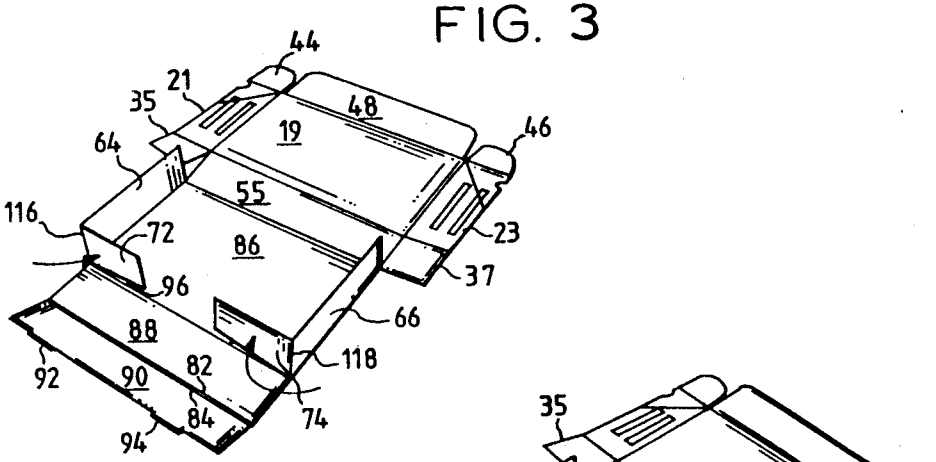
FIG. 3
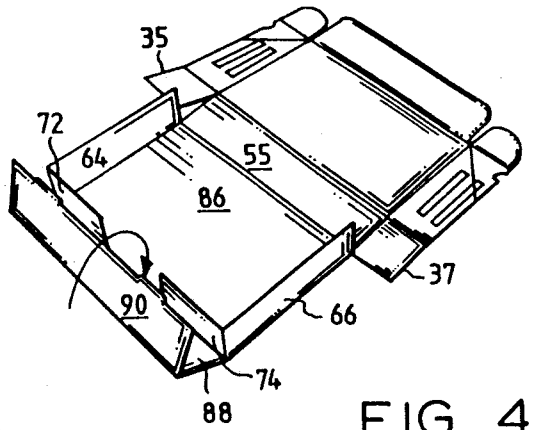
FIG. 4
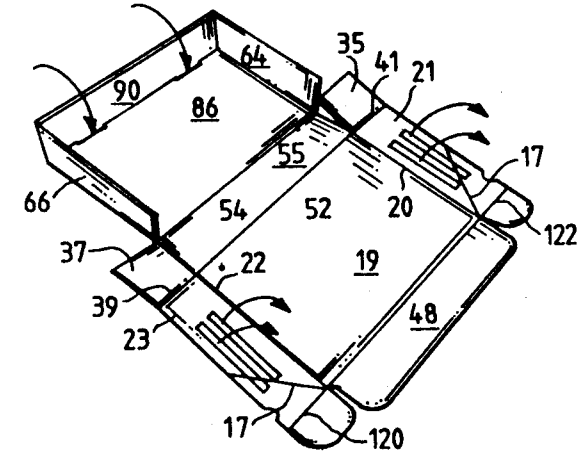
FIG. 6
FIG. 5

GIFT MAILING BOX

BACKGROUND

Field of the Invention

This invention relates to the field of packaging and more particularly the field of packaging consisting of preformed boxes that can be readily folded and formed by the user and used in the mailing of products though the United States mail.

Description of the Related Art

There have been a number of preformed boxes that are provided in gift shops or department stores for providing a package for gifts. These are typically formed from a single piece of thin cardboard and are provided to the user in a substantially flat configuration. The boxes are formed so as to permit the user to fold the blank so as to create a box.

The United States Post Office has standards that must be met for the use of boxes for mailing by the United States Post Office. The boxes must be able to withstand certain pressure and drop tests and bursting tests. The thin cardboard boxes described above do not meet these standards.

Also, the previously available pre-formed boxes do not have adhesive means associated with the boxes for preventing the opening of the boxes by unauthorized persons. Typically, in use in mailing, the boxes would be covered by wrapping paper, or otherwise sealed by external tape. Also a separate mailing label would have to be added by the user.

SUMMARY OF THE INVENTION

The present invention consists of a mailing box made of corrugated cardboard, formed from a single piece of corrugated cardboard. The mailing box is able to be folded such that there are multiple layers of support at the corners of the box to provide extra strength for protection against crushing. The box is constructed to permit folding in such a way as to be self-locking and has adhesive means applied to anterior surfaces for sealing the box when folded. Pressure sensitive adhesive tape is provided on the inside surfaces of the walls of the gift box so that during assembly it is sealable and protected from unauthorized persons or for use in mailing.

In the preferred embodiment, the box of the present invention has graphics for a suitable occasion, such as for Christmas or a Birthday, and a mailing label printed on the appropriate upper portion of the box so that the box itself can be used directly as the mailing box without the need for additional wrapping paper.

These and other objects and advantages of the present invention will be apparent from a review of the following specification and accompanying drawings.

OBJECTS OF THE PRESENT INVENTION

It is an object of the present invention to provide a gift box that is more convenient to use.

It is another object of the present invention to provide a gift box that is reliable.

It is another object of the present invention to provide a gift box that complies with United States Post Office Regulations for the mailing of boxes.

It is yet another object of the present invention to provide a gift box that provides improved protection for products within the box.

It is another object of the present invention to provide a gift box that provides added security to the contents from unauthorized persons.

It is still another object of the present invention to provide a gift box that has increased strength to resist crushing.

It is still another object of the present invention to provide a gift box that does not need wrapping or a label.

These and other objects of the present invention will be apparent after review of the following specification and accompanying drawings.

BRIEF DESCRIPTION OF THE DRAWINGS

FIGS. 2-11 are perspective views of the folding operations of the present invention.

DETAILED DESCRIPTION OF THE PREFERRED EMBODIMENTS

Figure 1:
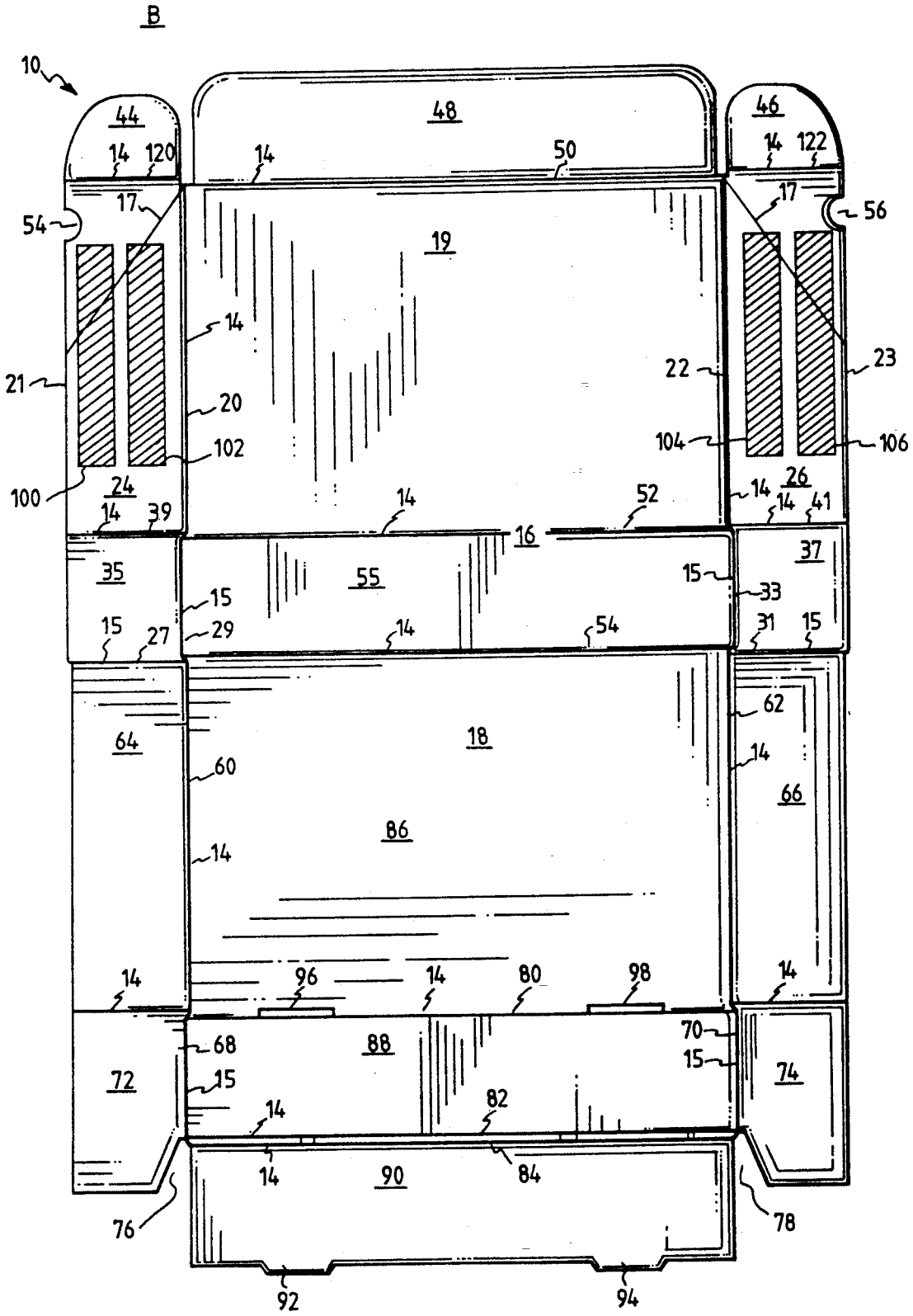
FIG. 1 is a plan view of the blank for the gift box of the present invention.
Figure 9:
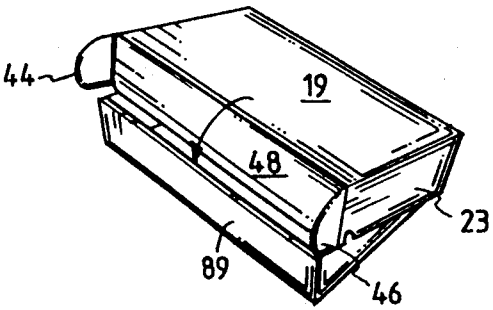
Figure 8:
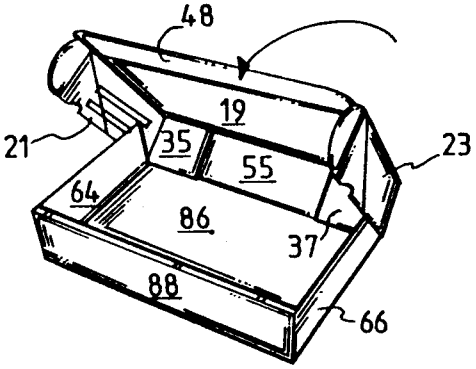
Figure 7:
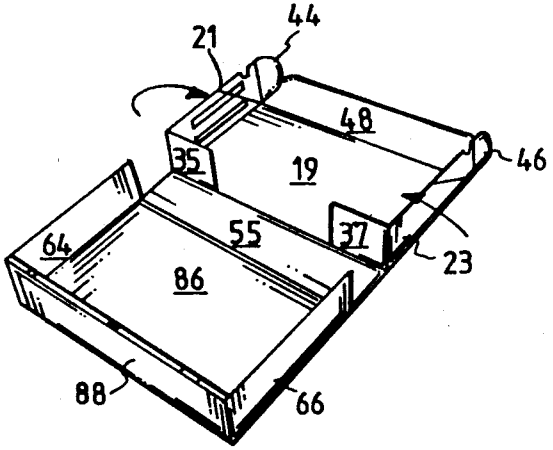

Referring to the drawings, FIG. 1 shows a plan view of the blank 10 used in the formation of the gift box B of the present invention. The blank is formed from a corresponding stamping die that presses against a large piece of cardboard and cuts out the perimeter of the blank and forms the scores, holes and other cuts on the blank, in a manner well known in the art of box making. The scores 14 are depressions in the blank 10 and are formed by projections on the die that press into the corrugated cardboard blank 10 sufficiently to form a score or fold line 14, but not to cut all the way through the blank 10. Cuts 15 are formed by sharpened depressions on the die that cut all the way through the blank. Slit scores 17 are sharpened depressions in the die that cut through the top layer of the corrugated cardboard.

Corrugated cardboard consists of an outer smooth layer of paper called the kraft liner, an interior corrugated or wrinkled layer, referred to in the trade as the medium, and a third layer also called the kraft liner. The thickness of the interior layer is known as the fluting. The size of the fluting can vary.

The blank 10 consists of two segments, a top segment 16 for forming the top and rear of the gift box B and a bottom segment 18 for forming the bottom and front of the gift box B.

The top segment consists of a generally rectangular segment 19 having side folds 20 and 22 formed parallel to one another for forming rectangular side segments 21 and 23, which when folded, form side walls 24 and 26 for the top segment. The ends of the rectangular side segments have cuts 27 and 29 and 31 and 33 for creating tabs 35 and 37. The tabs 35 and 37 have folds 39 and 41.

The side segments have at the opposite ends from the tabs 35 and 37 an arcuate cut forming semi circular tabs 44 and 46 and a flap 48. Three parallel and horizontal folds 50, 52 and 54 extending along the length of the upper and lower portion of the top segment and which, when folded, form the rear 55, top 19, and flap 48 of the completed gift box B.

The side panels 24 and 26 have a slit scores 17 at a diagonal to the extending from the cuts 50, 52 to the edges of the side segments 21 and 23, respectively. Semi-circular finger cut-outs 54, 56 are provided along the same respective edges.

The bottom segment 18 has a pair of parallel folds 60, 62 along the sides to form, when folded, the sidewalls 64 and 66. At the lower end of the side walls cuts 68, 70 form tabs 72 and 74. The die cuts a triangular segments 76, 78 for permitting ease of assembly and folding.

The bottom segment 18 has a three parallel folds 80, 82, and 84 extending from side to side. When folded, these parallel folds form the bottom 86, front 88, and interior front 90 walls of the completed gift box B. The interior front wall 90 is slightly shorter than the width of the front wall 88 and has a pair of extending tabs 92, 94 that are designed to fit with corresponding slots 96 and 98 in the bottom of the gift box B for holding the interior front wall 90 in place.

Adhesive strips 100, 102, 104, 106, having removable non-adhesive covers 108, 110, 112, 114 are provided along one side of the side walls 24, 26 of the upper side walls.

Figure 11:
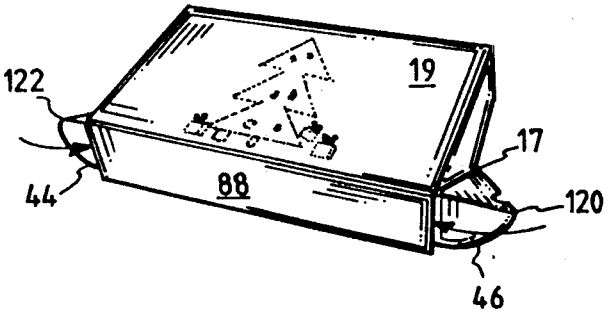

In the preferred embodiment, as showing FIG. 11, the gift box B of the present invention includes designs on the outside layer suitable for the gift, such as Christmas or birthday themes. Also, the upper portion of the completed gift box B may have a mailing label printed on the gift box B itself.

Referring to FIGS. 2–11 the assembly of the gift box B is shown. As shown in FIGS. 2–5, the tabs 72, 74 are folded along fold lines 116, 118 and the side wall panels of the bottom 64, 66 are folded along folds or scores 60 and 62 until the side walls 64, 66 are perpendicular to the bottom 86. The tabs 72, 74 are folded so that they are perpendicular to both the side walls 64, 66 and the bottom 86. The front wall segment 88 is then folded upwardly until it is also perpendicular to the bottom 86. The interior front wall 90 is then folded along scores 82, 84 so that it overlaps the tabs 72 and 74. The tabs 92 and 94 engage and fit within slots 96 and 98 in the bottom, thereby holding the front 88, 90 and side walls 64, 66 securely.

Referring to FIGS. 5–11, the top side walls 21, 23 and the tabs 35 and 37 are then folded along the score lines 20, 22 and 39, 41 until the side walls 21, 23 are perpendicular to the top segment 19, and the tabs 35, 37 are perpendicular to both the sid walls 21, 23 and the top 19. The top segment 19 is then folded along score lines 52 and 54 so that the tabs 35 and 37 are flush along the rear wall 55. The side walls 21 and 23 of the top 16 are positioned so as to overlap the side walls 64, 66 of the bottom 86. The top flap 48 is then folded along score line 50 and fitted within the bottom 86 so that it is flush against the interior front wall 90.

The folds having been creased, the box B is reopened and the object to be mailed or placed in the gift box B is placed in the box B.

Figure 10:
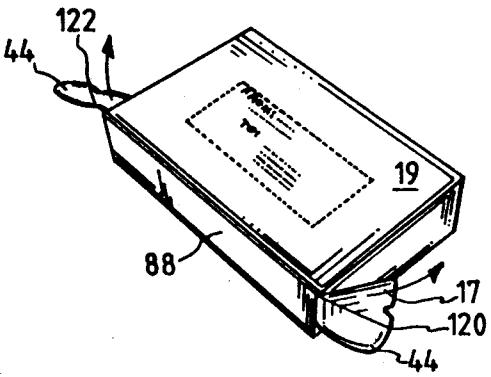

Referring to FIGS. 10 and 11, once the gift is in place, the side walls 21 and 23 are then bent along slit score lines 17 and the ends 44, 46 of the side walls 21, 23 are folded along slit score lines 17 and folds 120, 122 for insertion into the space formed between the front wall 88 and the interior front wall 90 of the bottom 86.

The finger slots 54 and 56 permit the easy opening of the gift box B. By inserting fingers under the finger slots 54, 56 the tabs 44 and 46 may be pulled out and the gift box opened.

If it is desired to have the box B secured to prevent unauthorized opening or when used as a mailing box, prior to folding the top over the bottom, the adhesive covering 108, 110, 112, 114 would be removed from the pressure sensitive adhesive tapes 100, 102, 104, 106 and then the remaining steps performed as indicated above. Once assembled, the sides 21, 23 proximate the tapes 100, 102, 104, 106 are pressed inwardly, pressing the adhesive against the bottom side walls 64, 66 and creating a secured gift box. The pressure sensitive tape or other suitable gluing means could be positioned at other locations to secure the gift box B.

The user would now write in the name and address of the person to whom the gift box B would be mailed on the mailing label provided. There would be no need to wrap the gift box B for mailing or gift giving.

In the preferred embodiment, the finished gift box B is about 2 inches high, about 10 inches wide and about 16 inches long. However, the gift box B may be made in any desired dimensions. In the preferred embodiment of the invention, the medium is E fluting, 200 pound test, and the kraft liners are known as 42 kraft. In larger boxes, B fluting which is a higher medium could be used instead of E fluting.

Figure 12:
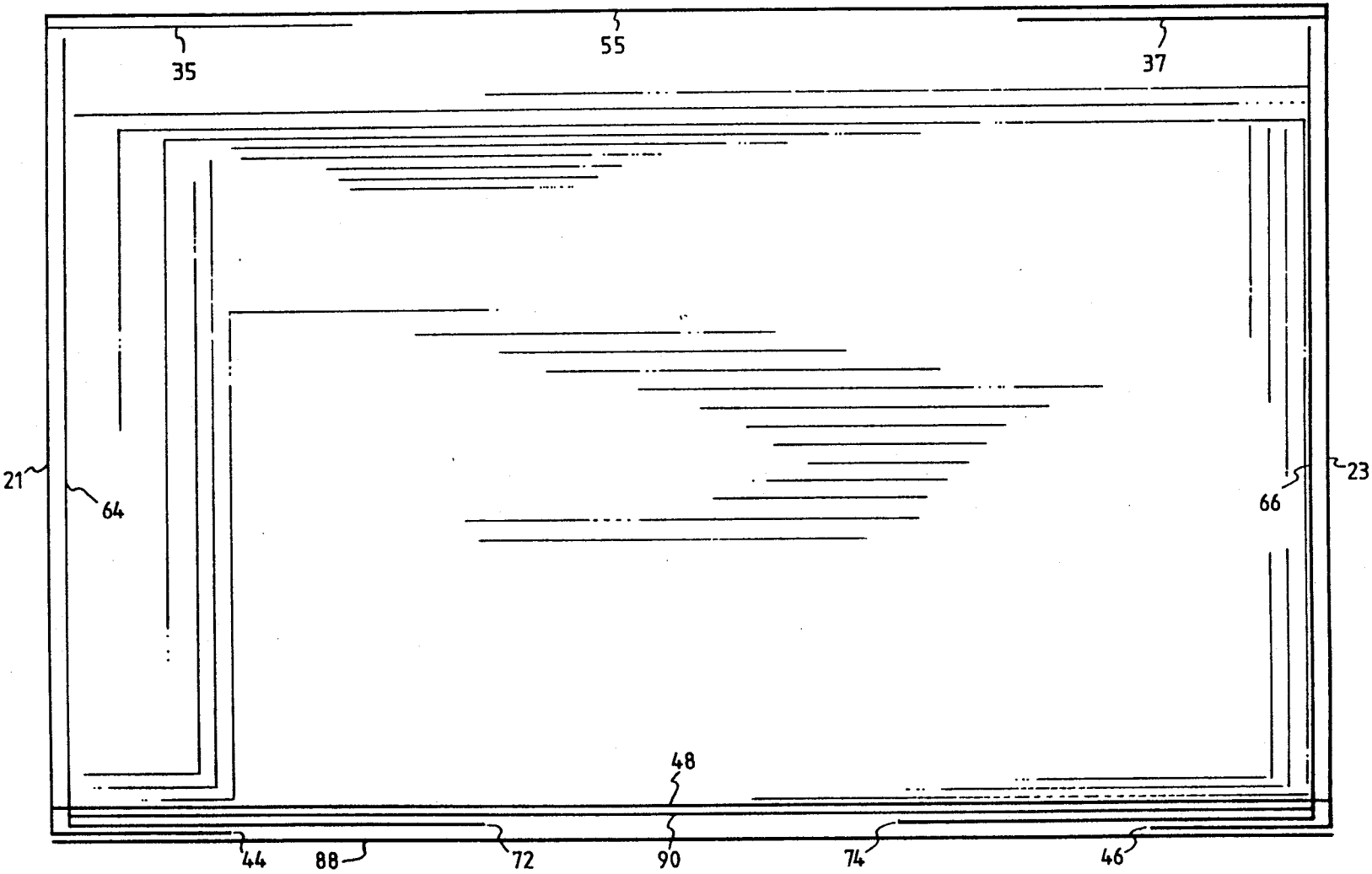
FIG. 12 is a top sectional view of the gift box taken along line 12—12 of FIG. 11 showing the internal layers of the finished gift box in representational line thickness.

As shown in FIG. 12, the top sectional view, there are multiple layers of cardboard at all of the corners of the gift box B. In each of the rear corners there are two layers and along each of the front corners there are four layers of cardboard, providing substantial resistance to crushing.

What is claimed is:

1. A foldable box formed from a single piece of folded corrugated cardboard comprising:

a main bottom segment, said main bottom segment having side walls and a front panel foldable over itself to form front walls, said folded front walls defining a space between said front walls;

a main top segment, connected to said main bottom segment, said main top segment having side walls, said side walls having projecting tab portions extending from the end of said side walls, said projecting tab portions capable of fitting within said space between said folded front panels of said main bottom segment, said side walls having a diagonal slit score whereby said projecting tab portions are capable of moving upwardly and away from said side walls for facilitating insertion of said projecting tab portions into said space.

2. The foldable box of claim 1, wherein said front panel of said main bottom panel further comprises:

projections extending from said front panel for fitting within corresponding slots in said main bottom segment.

3. The box of claim 1, further comprising:

at least one glue means is provided for gluing at least two of said walls together.

4. The box of claim 3 in which said glue means comprises pressure sensitive tape.

5. The box of claim 1, said box further comprising:

at least two layers of corrugated cardboard at two corners of said box and at least four layers of corrugated cardboard at two others corners of said box.

6. The box of claim 1, further comprising:

said box having graphic indicia on its exterior.

7. A foldable box formed from a single piece of folded corrugated cardboard comprising:

a main bottom segment, said main bottom segment having side walls and a front panel foldable over itself to form front walls, said folded front walls defining a space between said front walls;

a main top segment, connected to said main bottom segment, said main top segment having side walls, said side walls having projecting tab portions extending from the end of said side walls, said projecting tab portions capable of fitting within said space between said folded front panels of said main bottom segment;

at least two layers of corrugated cardboard at two corners of said box and at least four layers of corrugated cardboard at two other corners of said box; and said side walls having a diagonal slit score whereby said projecting tab portions are capable of moving upwardly and and away from said side walls for facilitating insertion of said projecting tab portions into said space.

8. The foldable box of claim 7, further comprising:

at least one glue means is provided for gluing at least two of said panels together.

9. The box of claim 7, further comprising:

said box having graphic indicia on its exterior.

* * * * *